United States Patent [19]

Althoff

[11] Patent Number: 4,502,900

[45] Date of Patent: Mar. 5, 1985

[54] ALLOY AND PROCESS FOR MANUFACTURING ROLLED STRIP FROM AN ALUMINUM ALLOY ESPECIALLY FOR USE IN THE MANUFACTURE OF TWO-PIECE CANS

[75] Inventor: Heinz J. Althoff, Oberursel, Fed. Rep. of Germany

[73] Assignee: Vereinigte Deutsche Metallwerke AG, Frankfurt am Main, Fed. Rep. of Germany

[21] Appl. No.: 538,735

[22] Filed: Oct. 3, 1983

Related U.S. Application Data

[62] Division of Ser. No. 341,944, Jan. 22, 1982, Pat. No. 4,431,463.

[30] Foreign Application Priority Data

Feb. 6, 1981 [DE] Fed. Rep. of Germany ..... 3104079
Mar. 17, 1981 [DE] Fed. Rep. of Germany ..... 3110277

[51] Int. Cl.[3] ..... C22C 21/02
[52] U.S. Cl. ..... 148/440; 148/439; 420/542; 420/543; 420/544; 420/546; 420/547
[58] Field of Search ..... 420/534, 535, 533, 532, 420/529, 542, 544, 546, 547, 543; 148/415, 416, 417, 440, 437, 11.5 A, 12.7 A; 220/1 BC

[56] References Cited

U.S. PATENT DOCUMENTS 1,797,851 3/1931 Bossert et al. ..... 420/542
3,306,787 2/1967 Dies ..... 148/440

FOREIGN PATENT DOCUMENTS 1038290 9/1958 Fed. Rep. of Germany ..... 420/546

*Primary Examiner*—L. Dewayne Rutledge
*Assistant Examiner*—Debbie Yee
*Attorney, Agent, or Firm*—Sprung, Horn, Kramer & Woods

[57] ABSTRACT

This invention relates to a wrought aluminum alloy, to its use for making semifinished and finished products and to processes of improving the properties, particularly the strength properties, of semifinished and finished products made of that alloy.

A wrought aluminum alloy is proposed which contains 1.15 to 2.0% manganese, more than 1.0 and up to 2.0% silicon, 0.25 to 0.65% magnesium, 0.2 to 1.0% iron, not in excess of 0.3% copper, not in excess of 0.2% zinc, not in excess of 0.1% zirconium, not in excess of 0.1% titanium, balance aluminum and other impurities in a total not in excess of 0.2%.

In FIG. 1, the ultimate tensile stresses which can be obtained with three different combinations of cooling rate and subsequent final cold reduction are plotted as a function of the magnesium content, the prior art being represented by magnesium contents of 0.2% and less.

32 Claims, 6 Drawing Figures

ALLOY AND PROCESS FOR MANUFACTURING ROLLED STRIP FROM AN ALUMINUM ALLOY ESPECIALLY FOR USE IN THE MANUFACTURE OF TWO-PIECE CANS

This is a division of application Ser. No. 341,944, filed Jan. 22, 1982, now U.S. Pat. No. 4,431,463.

This invention relates to a wrought aluminum alloy, to its use for making semifinished and finished products and to processes of improving the properties, particularly the strength properties, of semifinished and finished products made of that alloy.

The physical and chemical properties of aluminum can be modified in various ways by an addition of metallic alloying elements and can be improved in accordance with various objectives by suitable process steps.

For instance, German Patent publication No. 17 58 801 discloses for the manufacture of a can body a process in which an aluminum alloy is rolled to form a thin strip from which the can body is then formed by deep drawing and wall ironing. It has been proposed to use no soft-annealed strip portion, as usual, but to use as a starting material for the deep drawing and ironing operations a strip which consists of an aluminum alloy containing at least 96.5% aluminum, 0.75 to 2.5% iron and 0.1 to 2.5% magnesium and/or 1.1 to 1.5% manganese and silicon and other incidental impurities not in excess of 1%, and which has been cold-worked to an extent of at least 75%. Whereas can bodies of adequate strength can be made in this manner, the process cannot be used to make can covers, which are required to have in the cold-worked state an ultimate tensile stress of at least 350 N/mm$^2$ and an elongation of at least 6%. For this reason, two different aluminum alloys are required as starting materials for the manufacture of can bodies and can covers so that considerable disadvantages are involved, which will be discussed more fully hereinafter.

In the process disclosed in German Opened Application No. 18 17 243 fine-grained strip can be made from manganese-containing aluminum alloys if the strip which is being soft-annealed is held for at least 5 hours at temperatures in the range from 160° C. to slightly below the temperature of full recrystallization before the soft-annealing temperature is reached. In an recrystallized state, a strip having a thickness of 0.1 mm and consisting of an Al-Mn alloy containing 1.2 Mn, 0.6% Fe, 0.3% Si and 0.1% Cu which has thus been treated has an ultimate tensile stress of 110 to 130 N/mm$^2$; this is inadequate for numerous applications.

In another process disclosed in German Pat. No. 22 21 660, the elongation at break of high-strength aluminum alloys can be improved by a multi-stage annealing and forming process. That process is allegedly suitable for alloys containing 0.05 to 1% iron, 0.05 to 1% silicon and at least one alloying addition of the class containing of up to 5% magnesium, less than 3% manganese, less than 1% copper, less than 0.5% chromium, less than 0.5% zinc, less than 0.5% zirconium, less than 0.5% titanium and/or less than 0.1% boron, balance aluminum with the usual impurities involved in the manufacture in a total of less than 1.5% and in individual amounts below 0.5%. That process is relatively complicated and the ultimate tensile strength of about or above 450 N/mm$^2$ and the elongation of at least 5% have been stated only for an alloy which contains 0.08% silicon, 0.44% copper, 0.77% manganese, 0.10% chromium, 2.9% magnesium, 0.02% zinc, 0.17% iron, 0.01% titanium, balance aluminum. Owing to its high magnesium content such alloy is not suitable for articles which are to be deep-drawn or wall ironed or which must be brazed or porcelain enameled.

In view of the above, the efforts to improve the properties of aluminum alloys are often successful but restrict the field of application of the material; this is undesired in view of the need to save raw materials and energy. It is an object of the invention to provide a wrought aluminum alloy which has a very wide field of application and can be made to have properties in a wide range, possibly as a result of a processing under different conditions. The manufacture and recycling of such alloy should not involve special difficulties and the alloy should require only unproblematic alloying elements which are conventionally used with aluminum. That object will now be explained more in detail with reference to two specific problems.

Aluminum cans have increasingly been used for years as disposable containers for beverages. They consist of one-piece can bodies, which have been made by deep drawing and wall ironing, and a cover, which has a tear-off tab and is crimped onto the body when the latter has been filled. The starting materials for the manufacture of the can bodies and covers consist of rolled strips made from different aluminum alloys.

The covers are usually made from an AlMg 4.5 Mn alloy (U.S. code 5182) in a strongly cold-worked state (H19). After the partial softening resulting from stove-enameling, the alloy has an ultimate tensile stress of at least 350 N/mm$^2$ and an elongation of at least 6%. These values must be adhered to in order to ensure that the cover, which is weakened by the provision of embossed portions along the tear line, will resist the bursting pressure specified for cans filled with carbonated beverages, and that the cover can be crimped on without cracking. Tests conducted through many years have shown that the can bodies cannot be made from said alloy even when it is cold-worked to a lower degree. As the desired ratio of height to diameter cannot be obtained by deep drawing, the cans are made by deep drawing and wall ironing. It has been found that alloys containing more than 1% Mg tend to be abraded and to stick to the tool during ironing; such ironing will result in undesired grooves and interruption of production . Such alloys cannot be used for an economical manufacture of the can bodies. For this reason, an AlMnl Mgl alloy (U.S. Code 3004) is predominantly used to make the can body. Such alloy has the required ultimate tensile stress of at least 270 N/mm$^2$ and an elongation of 1% and can be ironed satisfactorily.

In view of the different requirements, two different alloys have previously been used in the manufacture of cans for beverages. That practice requires two production lines and a careful separation of the waste, which becomes available particularly as the circular blanks are punched. In addition, said practice greatly obstructs the efforts to save material and energy by a recycling of the emptied cans. Depending on the proportion of scrap, the alloy obtained by a melting of recycled cans contains about 1% Mn and more than 1% but less than 4.5% Mg. Such alloy must be processed to change its composition before it can be used to make covers or can bodies. To obtain one of the two alloys which can be used, expensive raw materials must be added so that the recycling is not economically interesting for a given manufacturer and the recycling of waste, which would be desirable from the aspect of overall economy, is not promoted as strongly as would be desirable.

To overcome said difficulties, a process disclosed in U.S. Pat. No. 3,787,248 has been proposed for the manufacture of strips for making covers from an alloy which has substantially the same composition as that used to make the can body.

That alloy is required to contain 0.5 to 2% Mn and 0.4 to 2% Mg, balance substantially Al. After a homogenizing treatment of 2 to 24 hours at about 455° to 655° C. (850° to 1150° F.), the material is hot-rolled and cold-rolled in a plurality of steps and at specified initial temperatures and with specified reductions and is then heat-treated to stabilize its structural state. In an optimum case, an ultimate tensile stress of 316 N/mm$^2$ (45 psi) and an elongation of 4% are achieved. It is apparent that even this comparatively expensive manufacturing process does not meet the requirements stated hereinbefore. They could be met if the Mg content were in the upper portion of the stated region, above 1 to 2%. But such alloy would certainly not be suitable for the manufacture of can bodies by ironing. For this reason the process proposed in said U.S. patent cannot be regarded as a satisfactory compromise.

In accordance with another proposal, disclosed in German Offenlegungsschrift No. 29 01 020, an alloy which contains 0.4 to 1% Mn and 1.3 to 2.5% Mg is to be used and by means of a strip-casting machine is to be cast continuously to form a strip. The cast strip is to be hot-rolled between preferably 490° and 280° C. with a reduction of at least 70% and is then to be coiled up, cooled in still air, and finally cold-rolled to its final thickness. The cold-worked strip has an ultimate tensile stress below 350 N/mm$^2$, which decreases to 330 to 310 N/mm$^2$ in dependence on the annealing temperature applied to simulate stoving. The desired elongation of at least 6% will not be obtained unless an annealing temperature of at least 200° C. is used, but this will reduce the ultimate tensile stress to about 325 N/mm$^2$. It is apparent that even this proposal will not result in the desired values for the cover material. As regards the difficulties encountered during ironing, it has merely been mentioned that the alloy employed exhibits a lower tendency to stick to the tool than conventional can strip alloys. For this reason the subject matter of German Offenlegungsschrift No. 29 01 020 altogether does not furnish a satisfactory solution to the problem set forth.

For this reason, it is still desired to provide an aluminum alloy which is equally suitable for covers and bodies of cans.

For other applications, aluminum alloys are required which can be brazed and porcelain enameled and which in a fully recrystallized state have certain minimum strength properties.

Semi-finished and finished products are stated to be suitable for brazing and porcelain enameling if except for a possibly required degreasing they need not be pretreated by chromating. anodizing, cladding, electroplating or the like. A structure is described as fully recrystallized if it is in a thermodynamically stable state, which in semifinished and finished products is described as "soft".

DIN 1725 and DIN 1745 (December 1976 issue) describe in their Sections 1 an Al-Mn alloy (Materials No. 3.0515) which has in a soft state an ultimate tensile stress of at least 90 N/mm$^2$ and a 0.2% offset yield point of 35 N/mm$^2$. Whereas an addition of Cu (Material No. 3.0517) can be used to increase the ultimate tensile stress to 145 N/mm$^2$, the 0.2% offset yield point will remain at 35 N/mm$^2$.

By an addition of Mg (Material No. 3.026), the ultimate tensile strength can be increased to at least 155 N/mm$^2$ and the 0.2% offset yield point can be increased to 60 N/mm$^2$ in a soft state.

Both measures adopted to increase the strength are not sufficient to meet the requirements involved here and result in disadvantages in other respects. The addition of 0.05 to 0.20% copper results in a considerable decrease of the resistance to corrosion. An Al-Mn alloy containing 0.8 to 1.3% Mg cannot be brazed or porcelain enameled. It is apparent that the requirements stated hereinbefore cannot be fulfilled in that manner.

Other known Al-Mn alloys which can be brazed and porcelain enameled and have improved strength properties have a wider field of application as a result of an addition of zirconium and/or chromium (see German Patent Specification No. 16 08 198, 16 08 766; German Patent Publication No. 25 29 064; German Opened Application No. 25 55 095). But in said cases only a structure which has a certain resistance to recrystallization, i.e., in which the strength decreases only at higher temperatures, is desired whereas in the required "soft" state said alloy has strength properties which are much lower than desired.

Parts made from such alloys can be subjected during their manufacture (brazing and porcelain enameling operations) and during their intended use to higher temperatures than conventional Al-Mn alloys because the added Zr and/or Cr will ensure that the strength increase which has been due to cold working will not appreciably decrease at elevated temperatures. But this resistance to recrystallization will be maintained only at temperatures below a certain limit or for a certain time of exposure. If certain limits are exceeded during the manufacture of the parts or during their intended use, the structure of said alloys is often transformed to a thermodynamically stable, i.e., soft state so that the strength properties are no longer sufficient for numerous applications.

In view of the above the statement of the object of the invention can be supplemented by the statement that an aluminum alloy is to be provided which meets all requirements involved in the manufacture of cans for beverages as well as the requirements involved in the manufacture of semifinished and finished products which can be brazed and porcelain enameled.

SUMMARY OF INVENTION

This object is accomplished by the provision of a wrought aluminum alloy which contains 1.15 to 2% manganese, more than 1.0% and up to 2.0% silicon, 0.25 to 0.65% magnesium, 0.2 to 1.0% iron, not in excess of 0.3 copper, not in excess of 0.2% zinc, not in excess of 0.1% zirconium, not in excess of 0.1% titanium, balance aluminum and other impurities in a total not in excess of 0.2%. All percents are on a weight basis.

The wrought aluminum alloy has preferably a silicon content of 1.2 to 1.8%, more preferably 1.38 to 1.57%. According to a preferred further feature of the invention the wrought aluminum alloy may contain 0.85 to 2% silicon if the contents of alloying elements meet the following conditions:

$$0.3\,(2Mg+Fe+Mn+1) \leqq Si$$

$Mn \geqq 1.5\ Fe$ $Mn + Fe \geqq 1.5$ $Mn + Si \geqq 2.3$

In the wrought aluminum alloy according to the invention, the restricted silicon contents stated above can also be used in combination with the above conditions.

For further improvement of strength and elongation, the alloy contains 0.1 to 0.3 percent by weight, preferably 0.15 to 0.25 percent by weight, copper.

Another aspect of the invention relates to semifinished products, particularly rolled strip, which consists of an alloy having a composition as stated hereinbefore. The invention relates also to semifinished or finished products which are made of said alloy and have in the cold-worked state an ultimate tensile stress of at least 350 $N/mm^2$ and an elongation of at least 6%. On the other hand, the semifinished or finished products made of said alloy should have in the fully recrystallized state an ultimate tensile stress of at least 150 $N/mm^2$ and a 0.2% offset yield point of at least 80 $N/mm^2$. Finally, semi-finished or finished products may be made from the alloy which have in the cold-worked state an ultimate tensile stress of at least 350 $N/mm^2$ and an elongation of at least 6% and in the fully recrystallized state an ultimate tensile stress of at least 150 $N/mm^2$ and a 0.2% offset yield point of at least 80 $N/mm^2$.

Rolled strip can be made from an alloy composed in accordance with the invention in that an ingot is hot-rolled and/or cold-rolled to an interstage thickness $D_z$ and the resulting intermediate strip is process-annealed at 450 to 580° C. and is subsequently cooled at a controlled rate of at least V (°K/s) and is then rolled with a controlled reduction of at least $\rho$ (%) to a controlled final thickness $D_e$. In dependence on the required final strength $R_m(N/mm^2)$, the following requirement should be met during the manufacture:

$$\rho \geqq \frac{8.5 \times \sqrt[2]{R_m - 275}}{\sqrt[3]{\log (V + 1^*)}}$$

*refers to the number "one"

If the rolled strip is required to have a final strength in the range of 220 to 275 $N/mm^2$, the above-mentioned process can be modified in that the intermediate strip is annealed at 450° to 580° C. and is then cooled in still air and is thereafter cold-rolled to the final thickness with a final reduction $\rho = f(R_m)$ in accordance with the graph of FIG. 2. On the other hand, if a final strength in the range of 220 to 275 $N/mm^2$ is required, the ingot can be rolled directly to the final thickness in the usual manner and can then be annealed at 450° to 580° C. and then cooled below 250° C. at a rate $V = f(R_m)$ in accordance with the graph of FIG. 3. A strip which has been made by strip casting and cooled at at least 10° K/sec can be hot-rolled and/or cold-rolled directly to the final thickness without process annealing. It is generally desirable to roll to an intermediate thickness $D_z$ of 1 to 4 mm and/or to a final thickness $D_e$ of 0.20 to 0.50 mm. The alloy or the rolled strip made from it are preferably used for making finished products, particularly cans, or only can bodies or can covers.

To make semifinished or finished products which can be brazed and porcelain enameled from the alloy according to the invention, the semifinished or finished products are substantially recrystallized by a heat treatment at 450° to 600° C. for at least 3 minutes. That final heat treatment may suitably be carried out during the stoving of the porcelain enamel or during the brazing operation. $\rho f(Rm)$ means $\rho$ is a function of Rm, or $\rho$ is depending from Rm in a distinct manner. The same is with $V = f(Rm)$.

The invention permits the use of a single aluminum alloy in making the can bodies and can covers. As a result, all of the difficulties are eliminated which arise from the previously conventional use of two different alloys so that the recycling of the can material has become much more interesting economically and all parties concerned, namely, the canmakers, the fillers of beverages and the consumers are more strongly incented to return the material of the emptied beverage cans so that it can be re-used.

A very important advantage of the process according to the invention residues in that the alloy may contain much less magnesium than the aluminum alloys previously used for beverage cans. About 1 million metric tons of rolled strip were used in the United States for beverage cans in 1978. If a high proportion of the scrap, about 40%, is recycled, 600,000 tons of new material will be required. If 1% magnesium can be replaced by 1% silicon for that amount, and it is assumed that the prices of these metals differ by about 3 deutschemarks per kg and 6000 metric tons of alloying material are required, a saving of 6000 metric tons × 3000 deutschemarks per metric ton = 18 million deutschemarks will result from the use of the process according to the invention to produce the strip annually required.

The assumedly 40% of recycled can scrap can be processed to produce 400,000 metric tons of can strip (320,000 metric tons for can bodies and 80,000 metric tons for can covers). For this processing, about 2000 metric tons magnesium are required to make up the cover alloy and about 78,000 metric tons virgin aluminum are required to dilute the can body material. If the can scrap consisted of a uniform material produced in accordance with the invention, the material could be re-used virtually without an addition of new metal. This would result in a further saving of an order of six million deutschemarks only by the elimination of the costs of new magnesium metal. Obviously the above-mentioned savings depend mainly on the prices of metals but even higher savings may be expected in the future because the production of pure metal involves a high consumption of energy and the energy costs tend to increase further.

BRIEF DESCRIPTION OF DRAWINGS

Reference is made to the drawings in which.

DESCRIPTION OF SPECIFIC EMBODIMENTS

Figure 1:
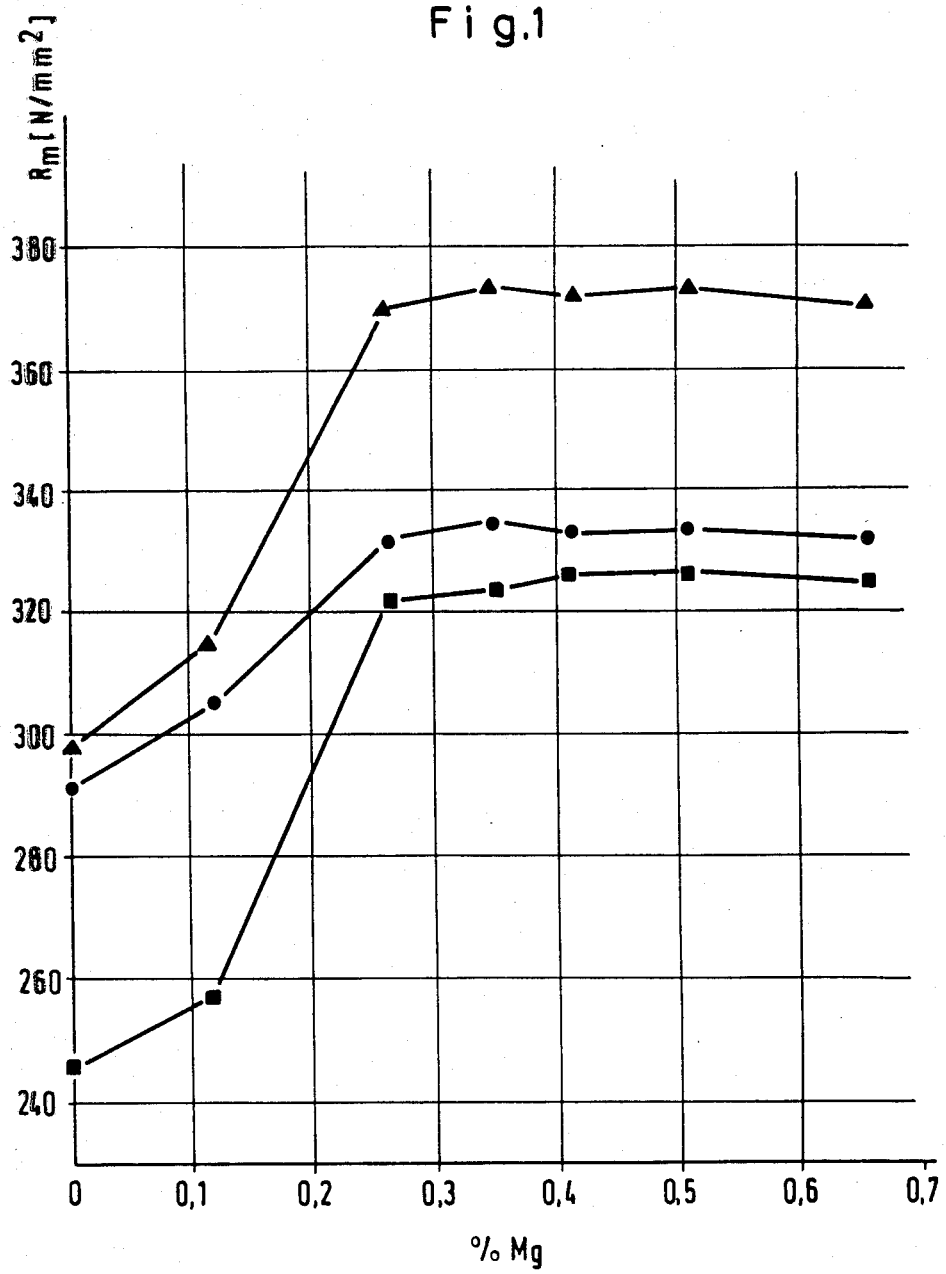
FIG. 1 is a graph showing the ultimate tensile strength (Rm in $N/mm^2$) obtained in relation to the magnesium content of the alloy for various cooling rates and reductions after a process annealing at 520° C.

Referring to the drawings, especially FIG. 1, samples 1 and 2 of Table 1 contain less than 0.25% magnesium and exhibited only comparatively low ultimate tensile strengths when processed under all cooling and rolling conditions. Distinctly higher ultimate tensile strength is obtained with samples 3 to 7 and this was virtually independent of the magnesium content, which was varied between 0.26 and 0.66%. An ultimate tensile strength above 370 N/mm$^2$ is obtained after a cooling at 90° K/s and a rolling with a reduction of 75% (upper curve). If the same cooling rate was combined with a rolling with a reduction of 45%, the ultimate tensile stresses are about 325 N/mm$^2$ (lower curve). The intermediate curve is associated with a cooling at only 2° K/s and a rolling to final thickness with a reduction of 82%. This results in an ultimate tensile strength of about 335 N/mm$^2$.

From these test results it is apparent that magnesium contents above 0.25% do not influence the final strength and in the investigated range can be selected as desired, possibly with a view to other requirements in the manufacture of beverage cans.

It is also apparent that if the process parameters are properly selected the ultimate tensile stress of 350 N/mm$^2$ required for can covers can be obtained and distinctly exceeded so that the material meets the requirements, even when it has been slightly softened by stove-enameling. On the other hand, the two lower curves show that the use of a high cooling rate and a rolling with a small reduction can be used for the same results as with a low cooling rate and a rolling with a large reduction. If a continuous annealing and quenching plant is not available for making the strip, the same result can be obtained by rolling with a larger reduction. Conversely, the final rolling can be effected with a smaller reduction, i.e., more economically, if cooling can be effected at sufficiently high rates.

Figure 4:
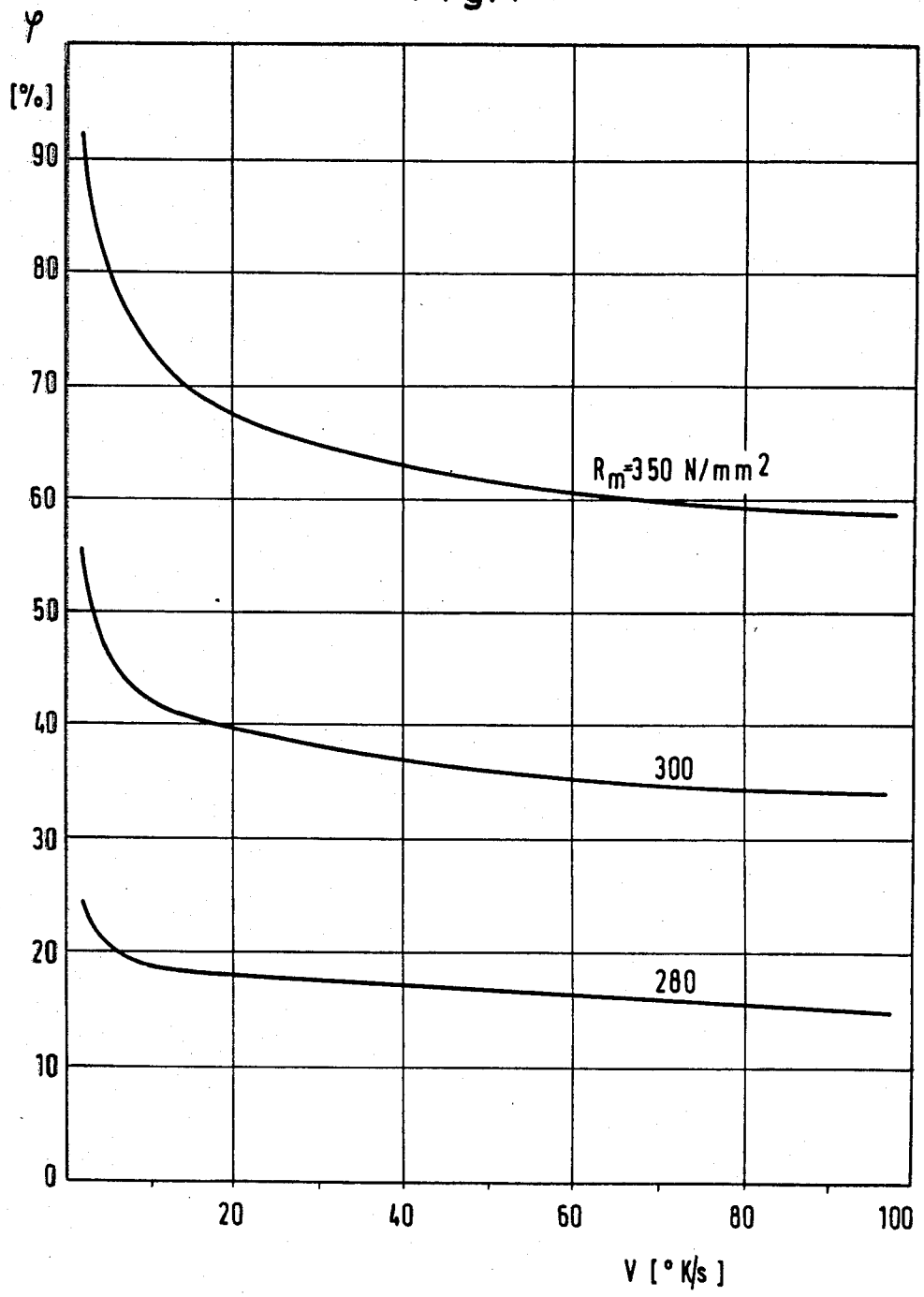
FIG. 4 is a graph showing the relationship of reduction to ultimate tensile strength.

In the inequation stated above this relationship is defined with reference to the required ultimate tensile strength. The relationship has been shown in the graph of FIG. 4 for various values of ultimate tensile strength. As the reduction $$\rho = \frac{D_z - D_e}{D_z} \times 100\%$$

($D_z$ = intermediate thickness, $D_e$ = final thickness)

the inequation may be written as follows:

$$D_z \geqq \frac{D_e}{1 - 0.085 \dfrac{\sqrt[2]{R_m - 275}}{\sqrt[3]{\log (V + 1)}}}$$

In practical operation, the required intermediate thickness can readily be calculated in dependence on the cooling rate which can be achieved if the final ultimate tensile strength and the final thickness which are required are known.

It is also pointed out that the inequation for $\rho$ is applicable only for values of $R_m \geqq 275$ N/mm$^2$. If $R_m = 275$ N/mm$^2$, $\rho$ will be $\geqq 0$ so that a further rolling will not be required, regardless of the cooling rate.

In the practice of the invention, ultimate tensile strength above 275 N/mm$^2$ will mainly be of interest but even for lower strengths the alloy can be processed under conditions which result in a predetermined final ultimate tensile stress.

Figure 2:
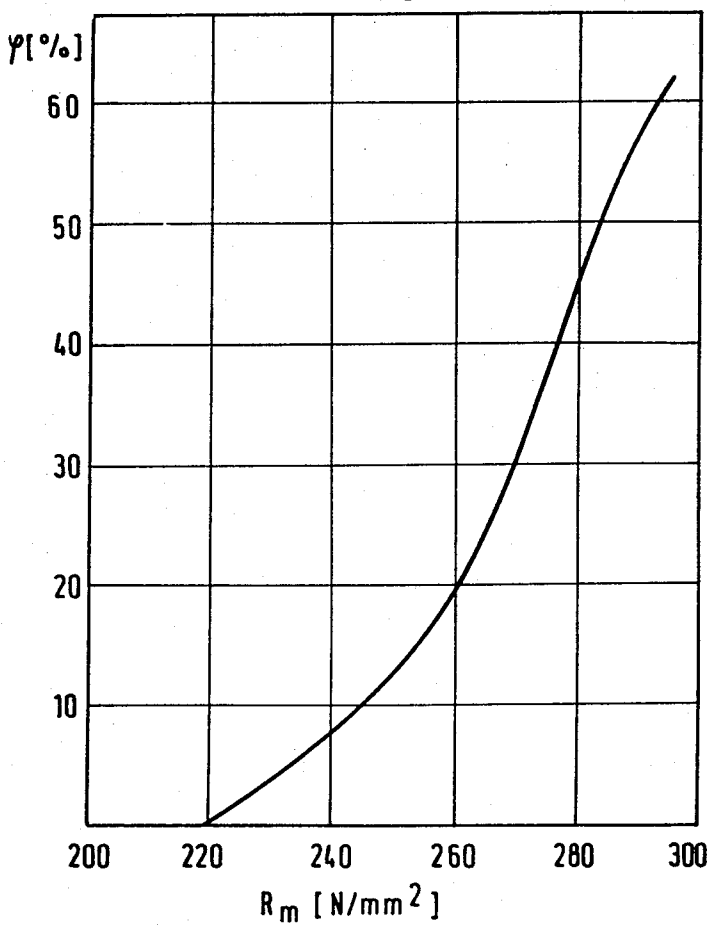
FIG. 2 is a graph showing the relationship of ultimate tensile strengths to reduction.

FIG. 2 shows the required reduction to be effected by rolling in dependence on the required ultimate tensile strength for a strip which has been annealed at 520° C. and cooled at about 2° K/s in still air. The resulting strip has an ultimate tensile stress of about 220 N/mm$^2$. That value can be increased to about 290 N/mm$^2$ by a rolling with a reduction of 60%.

Figure 3:
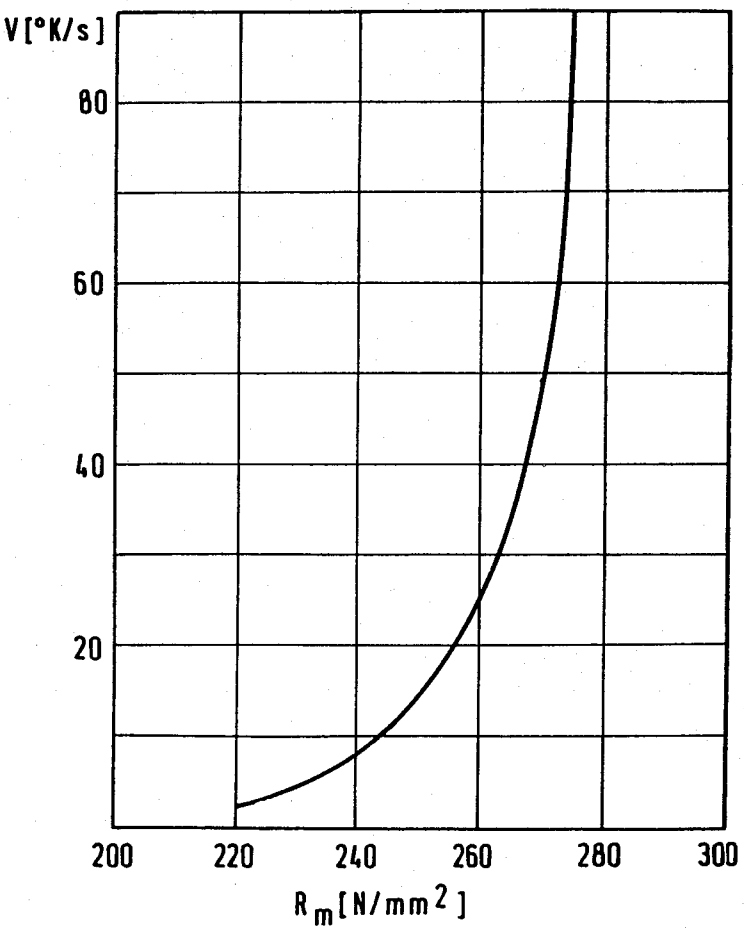
FIG. 3 shows the relationship of ultimate tensile strength to cooling rate.

FIG. 3 shows the required cooling rate in dependence on a specified final ultimate tensile strength for a strip which has been rolled to final thickness and then annealed at 520° C.

Based on the alloy according to the invention, a process has been described by which strip for making beverage cans can be made, which may have any final strength required in that field of application. The strip material which is thus made available may be used to make can covers which are required to have an ultimate tensile stress of at least 350 N/mm$^2$; it may also be used to make can bodies by deep drawing and ironing because owing to its low magnesium content it can be subjected to these forming operations without difficulty. It is apparent that cans for beverages can now be made in a greatly simplified process by which the recycling of waste is rendered more interesting economically and which involves very substantial savings.

In the manufacture of semifinished and finished products which can be soldered and enameled, the final heat treatment is suitably carried out at 450° to 600° C. It will be particularly desirable to subject semifinished or finished products to be porcelain enameled to the final heat treatment during the stoving of the porcelain enamel. Semifinished or finished products to be brazed are desirably subjected to the final heat treatment during the soldering operation. The ultimate tensile stress and the 0.2% offset yield point can be further increased in that the semi-finished or finished products are subjected to an enforced cooling after the final heat treatment. If the final heat treatment is to be carried out at a temperature near the upper temperature limit, the magnesium content of the alloy must be restricted to 0.25 to 0.50%.

In a similar process (see German Patent Specification No. 27 54 673), a comparable alloy containing magnesium not in excess of 0.2% is obtained which has the desired ultimate tensile stress of at least 150 N/mm$^2$ but does not have the required 0.2% offset yield point of at least 80 N/mm$^2$. Regardless of the temperature at which the final heat treatment is carried out, said yield point is about or slightly above 50 N/mm$^2$ and is not sufficient for various applications. It has surprisingly been found that the 0.2% offset yield point can be considerably improved in that the Mg content is increased to 0.25 to 0.65% and that this will not adversely affect the brazing and porcelain enameling operations. It was previously believed that Al-Mn alloys containing more than 0.2% could be porcelain enameled only after an expensive pretreatment. It has even been stated in the literature that the Mg content should be less than 0.01% or less than 0.05% (see Aluminium-Taschenbuch, 14th edition (1974), page 734, paragraph 4; Z. Aluminum, 47th Year (1971), page 688, Table 1).

Specimens composed in accordance with Table 1 were tested. Specimens 1 and 2 correspond to German Patent Specification No. 27 54 673. The remaining specimens have increasing Mg contents within the claimed range. Table 2 indicates the strength properties obtained after an annealing for 30 minutes at a temperature of 560° C., which is usual for the stoving of porcelain enamel. Ultimate tensile stresses above 200 N/mm² were obtained on conjunction with constant elongations of about 20%. All specimens proved satisfactory in the spall resistance test in accordance with Merkblatt DEZ F 17 Deutsches Email-Zentrum after they had been kept in an antimony trichloride solution for 96 hours. These results disprove the widespread belief that an addition of magnesium should always be avoided in Al-Mn alloys which are to be enameled (Z. Aluminium, 47th Year (1971), page 688, right-hand column, paragraph 3).

Figure 5:
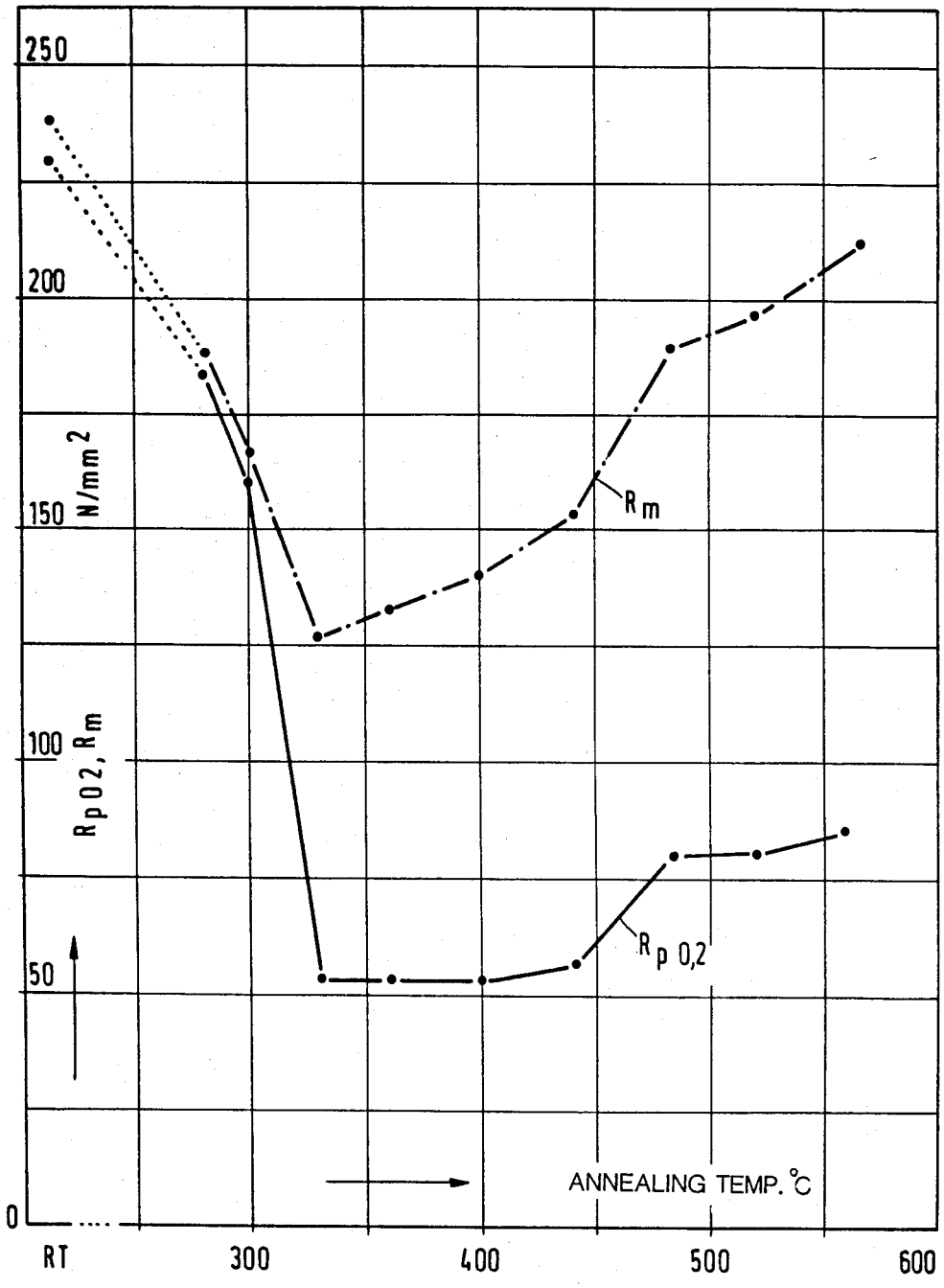
FIG. 5 is a graph showing the relationship of ultimate tensile strength to final heat treatment temperature.

In FIG. 5 the increase of the ultimate tensile strength and the 0.2 offset yield point in dependence on the temperature of the final heat treatment is represented for an alloy containing 1.55% Mn, 1.53% Si, 0.39% Mg, 0.61% Fe, 0.09% Zr, balance aluminum and impurities. It is clearly seen that both values increase remarkably above 450° C. Unless magnesium is used in the claimed proportion, the 0.2% offset yield point cannot be increased and the ultimate tensile stress does not increase substantially above 160 N/mm² (see German Patent Publication No. 27 54 673, Graph I.). On the other hand, the 0.2% offset yield point can be increased above 80 N/mm² in the soft state when the teaching according to the invention is followed.

Figure 6:
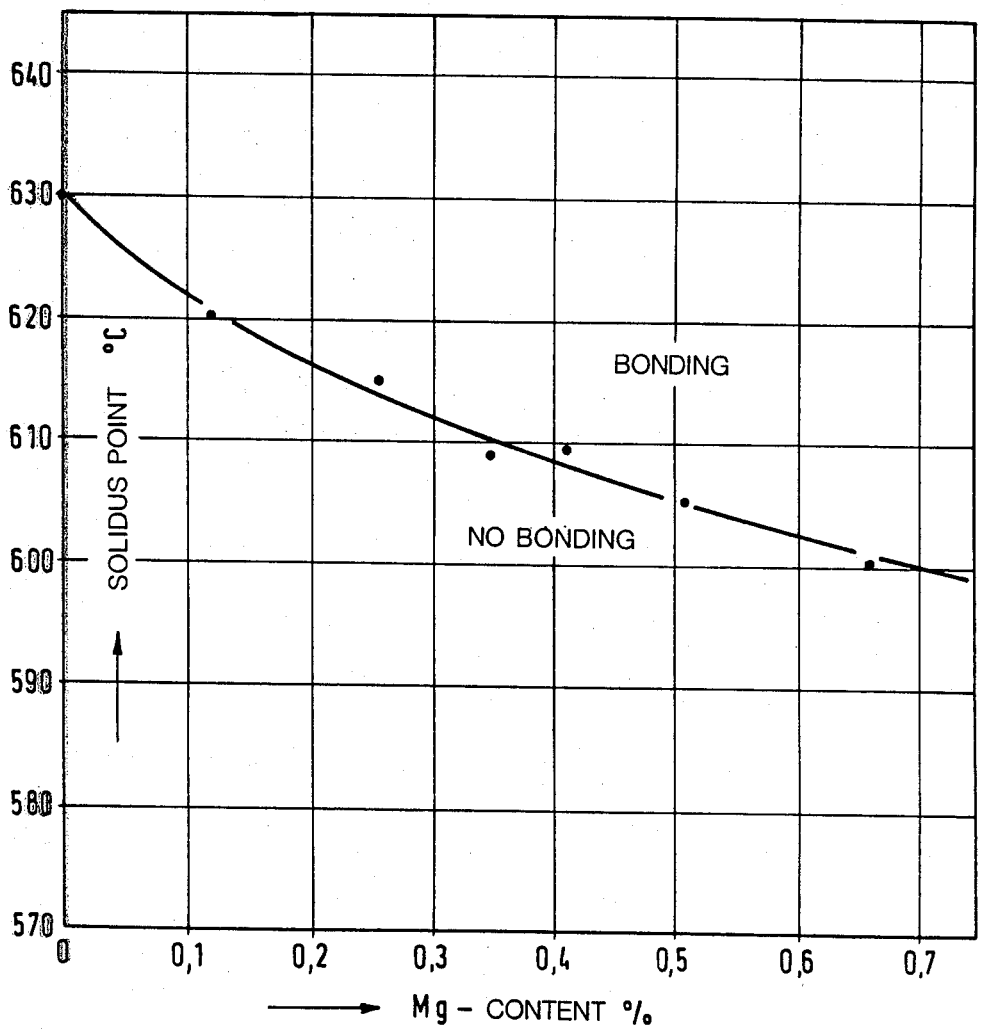
FIG. 6 is a graph showing the relationship of magnesium content to brazing temperature and shows those conditions at which incipient melting occurs.

It was believed that magnesium adversely affects the wetting of Al-Mn alloys by fluxes for brazing. It can be assumed that this disadvantage will be avoided just as the decrease of the bond strength of enamel if the alloying elements are used in proportions according to the invention. But as higher temperatures are usually employed for brazing than for enameling, the fact that the solidus temperature decreases as the Mg content increases must be taken into account. That relationship is apparent from FIG. 6. For such application the upper limit for the Mg content must be decreased in dependence on the brazing temperature. It will usually be sufficient to use a Mg content of 0.5% in order to avoid an incipient melting at a brazing temperature up to 600° C.

TABLE I

| Specimen No. | Chemical Composition (%) | | | | | | |
|---|---|---|---|---|---|---|---|
| | Mg | Cu | Fe | Si | Mn | Others | Al |
| 1 | <0.0 | 0.06 | 0.52 | 1.51 | 1.40 | <0.1 | balance |
| 2 | 0.12 | 0.06 | 0.49 | 1.32 | 1.38 | <0.1 | balance |
| 3 | 0.26 | 0.06 | 0.50 | 1.40 | 1.38 | <0.1 | balance |
| 4 | 0.35 | 0.07 | 0.51 | 1.38 | 1.37 | <0.1 | balance |
| 5 | 0.41 | 0.13 | 0.52 | 1.52 | 1.37 | <0.1 | balance |
| 6 | 0.51 | 0.13 | 0.53 | 1.57 | 1.39 | <0.1 | balance |
| 7 | 0.66 | 0.13 | 0.55 | 1.52 | 1.39 | <0.1 | balance |

TABLE 2

| Specimen No. | $R_p$ 0.2 N/mm² | $R_m$ N/mm² | $A_5$ % | Spall Resistance Test after immersion in $SbCl_3$ solution for 96 h |
|---|---|---|---|---|
| 1 | 50 | 165 | 20 | Passed in accordance with Merkblatt DEZ F 17 of |
| 2 | 57 | 145 | 18 | |
| 3 | 85 | 208 | 19 | |

TABLE 2-continued

| Specimen No. | $R_p$ 0.2 N/mm² | $R_m$ N/mm² | $A_5$ % | Spall Resistance Test after immersion in $SbCl_3$ solution for 96 h |
|---|---|---|---|---|
| 4 | 94 | 227 | 20 | Deutsches Email-Zentrum |
| 5 | 95 | 225 | 20 | |
| 6 | 98 | 231 | 20 | |

Combination of P 31 04 079.9 "Aluminum Cans" and P 31 10 227.1 "AlMnSi with Mg"

What is claimed is:

1. A wrought aluminum alloy, characterized in that it consists of 1.15 to 2.0% manganese, more than 1.0 and up to 2.0% silicon, 0.25 to 0.65% magnesium, 0.2 to 1.0% iron, not in excess of 0.3% copper, not in excess of 0.2% zinc, not in excess of 0.1% zirconium, not in excess of 0.1% titanium, balance aluminum and other impurities not in excess of a total of 0.2%.

2. A wrought aluminum alloy according to claim 1, characterized by a silicon content of 1.2 to 1.8%.

3. A wrought aluminum alloy according to claim 1, characterized by an silicon content of 1.38 to 1.57%.

4. A wrought aluminum alloy according to any of claims 1 to 3, which contains 0.85 to 2.0% silicon and wherein the contents of alloying elements meet the following conditions:

$$0.3(2Mg+Fe+Mn+1) \leqq Si$$

$$Mn \geqq 1.5Fe$$

$$Mn+Fe \geqq 1.5$$

$$Mn+Si \geqq 2.3$$

5. A wrought aluminum alloy according to claim 4, characterized by a silicon content of 1.2 to 1.86.

6. A wrought aluminum alloy according to claim 1, 2, 3, 4 or 5 wherein the copper content is 0.1 to 0.3 percent.

7. Semifinished products made of an alloy according to claim 1, 2, 3, 4, 5 or 6.

8. Rolled strip made of an alloy according to claim 1, 2, 3, 4, 5 or 6.

9. Semifinished or finished products of an alloy according to claim 1, 2, 3, 4, 5, or 6 characterized in that they have in a cold-worked state an ultimate tensile stress of at least 350 N/mm² and an elongation of at least 6%.

10. Semifinished or finished products made of an alloy according to claim 1, 2, 3, 4, 5, or 6 characterized in that they have in a fully recrystallized state an ultimate tensile stress of at least 150 N/mm² and a 0.2% offset yield point of at least 80 N/mm².

11. Semifinished or finished products made of an alloy according to claim 1, 2, 3, 4, 5 or 6, characterized in that they have in the cold-worked state an ultimate tensile stress of at least 350 N/mm² and an elongation of at least 6% and have in a fully recrystallized state an ultimate tensile stress of at least 150 N/mm² and a 0.2% offset yield point of at least 80 N/mm².

12. A can comprising a can body, a can cover and a can bottom wherein at least one of said can body, said can top and said can bottom are made of the alloy of claim 1.

13. A can comprising a can body, a can cover and a can bottom wherein said can cover is made of the alloy of claim 1.

14. A can according to claim 13 wherein said can body is made of the alloy of claim 1.

15. A can according to claim 13, wherein said can bottom is made of the alloy of claim 1.

16. A can according to claim 13, wherein said can body is a one piece body.

17. A can according to claim 16 wherein said can cover is crimped to said can body.

18. A can according to claim 13 wherein said can cover has an ultimate tensile stress of at least 350 $N/mm^2$.

19. A can according to claim 13 wherein said can cover has an ultimate tensile stress in the cold-worked state of at least 350 $N/mm^2$ and an elongation of at least 6 percent.

20. A can according to claim 12 wherein said can cover has a moveable tab which when moved exposes an opening.

21. A can according to claim 12 wherein said can cover has a tear-off tab.

22. A can according to claim 12 wherein said can body is made of the alloy of claim 1.

23. A can according to claim 14, wherein said can body has an ultimate tensile stress of at least 270 $N/mm^2$.

24. A can according to claim 23, wherein said can body has an ultimate tensile stress of about 350 $N/mm^2$.

25. A can cover made of the alloy of claim 1.

26. A can cover according to claim 25 wherein said can cover has a moveable tab which when moved exposes an opening.

27. A can cover according to claim 25, wherein said can cover has a tear-off tab.

28. A wrought aluminum alloy according to claim 1, containing 0.25 up to but less than 0.5 percent by-weight magnesium.

29. A wrought aluminum alloy according to claim 1, containing 0.25 up to 0.41 percent by-weight magnesium.

30. A wrought aluminum alloy according to claim 29, containing 1.2 to 1.8 weight percent silicon.

31. A wrought aluminum alloy according to claim 30, containing iron in an amount of 0.49 to 0.52 weight percent.

32. A wrought aluminum alloy according to claim 30, containing manganese in an amount of 1.37 to 140 weight percent.

* * * * *

UNITED STATES PATENT AND TRADEMARK OFFICE

CERTIFICATE OF CORRECTION

PATENT NO. : 4,502,900

DATED : March 5, 1985

INVENTOR(S) : Heinz J. Althoff

It is certified that error appears in the above-identified patent and that said Letters Patent is hereby corrected as shown below:

| | |
|---|---|
| Col. 3, line 65 | Delete "Materials" and substitute --Material-- |
| Col. 4, line 67 and Col. 10, line 28 | Delete "$\leqq$" and substitute -- $\leq$ -- |
| Col. 5, lines 37, 43, 54; Col. 6, line 8 (3 instances); Col. 7, lines 50, 67; Col. 8, line 1 | Delete "p" and substitute -- $\varphi$ -- |
| Col. 5, lines 1, 2, 3 and 43; Col. 7, lines 56, 68; Col. 8, line 1; Col. 10, lines 30, 32, 34 | Delete " $\geqq$ " and substitute -- $\geq$ -- |
| Col. 9, line 66, Table 2, col. 3, line 2 under heading | Delete "145" and substitute --175-- |
| Col. 12, line 24 | Delete "140" and substitute --1.40-- |

Signed and Sealed this

Tenth Day of September 1985

[SEAL]

Attest:

DONALD J. QUIGG

Attesting Officer

Acting Commissioner of Patents and Trademarks - Designate